US005391957A

United States Patent [19]

Fendley

[11] Patent Number: 5,391,957

[45] Date of Patent: Feb. 21, 1995

[54] VIBRATION DAMPING MEANS FOR A STRIP SHADOW MASK

[75] Inventor: James R. Fendley, Arlington Heights, Ill.

[73] Assignee: Zenith Electronics Corporation, Glenview, Ill.

[21] Appl. No.: 998,093

[22] Filed: Dec. 28, 1992

[51] Int. Cl.[6] ..... H01J 29/02
[52] U.S. Cl. ..... 313/402; 313/269
[58] Field of Search ..... 313/402, 407, 269, 293; 445/30

[56] References Cited

U.S. PATENT DOCUMENTS

| | | | |
|---|---|---|---|
| 3,549,932 | 12/1970 | Lindeman | 445/30 |
| 4,333,034 | 6/1982 | Ohgoshi et al. | 313/407 |
| 4,504,764 | 3/1985 | Sakamoto et al. | 313/269 |
| 4,778,427 | 10/1988 | Strauss | 445/30 |
| 4,780,641 | 10/1988 | Hashiba et al. | 313/269 |

*Primary Examiner*—Donald J. Yusko
*Assistant Examiner*—Vip Patel
*Attorney, Agent, or Firm*—Ralph E. Clarke, Jr.

[57] ABSTRACT

A color CRT has a strip-type shadow mask and a magnetic shield internal to the funnel. At least one wire is suspended between the walls of the magnetic shield in contact with the strips of the mask to dampen image-distorting vibration of the strips.

4 Claims, 3 Drawing Sheets

VIBRATION DAMPING MEANS FOR A STRIP SHADOW MASK

CROSS-REFERENCE TO RELATED APPLICATIONS

This application is related to but in no way dependent upon applications Ser. No. 07/997,410, filed Dec. 28, 1992, and Ser. No. 07/997,409, filed Dec. 28, 1992, all of common ownership herewith.

BACKGROUND OF THE INVENTION

1. Field of the Invention

This invention relates to tension mask color cathode ray tubes (CRTs) having a front assembly including a faceplate with a striped screen and a strip-type shadow mask mounted on mask support structures attached to the faceplate. The invention is addressed specifically to an improved means for damping the vibration of the strips of the mask.

2. Discussion of Related Art

A CRT and its Front assembly known in the art, and which utilizes a tensed strip shadow mask, is depicted in FIGS. 1 and 2. Cathode ray tube 20 has a front assembly 22 that includes a rectangular glass faceplate 24 which is sealed to a funnel 26. The x-axis of the Faceplate 24, commonly known as the horizontal axis, and the y-axis, commonly known as the vertical axis, are indicated in FIG. 2.

The neck 28 that extends from funnel 26 encloses an in-line electron gun 30 that projects three discrete electron beams 32 that excite the phosphor stripes deposited on screen 38 to produce a color image visible from the outer surface 40 of faceplate 24. A magnetic shield 42 internal to the funnel 26 and having walls approximately conforming to the shape of the funnel, provides for shielding the tube 20 from the effects of stray magnetic fields that may emanate from nearby electrical components, and from the influence of the terrestrial magnetic field. The centrally disposed striped screen 38 is deposited on a rectangular area on the inner surface 44 of faceplate 24. Striped screen 38 consists of patterns of spaced deposits of phosphor oriented in a first direction, indicated by FIG. 2 as being approximately along the y-axis, by way of example. Two shadow mask supports 48 and 50, hereafter termed "rails," are affixed to the inner surface 44 of faceplate 24 on opposed sides of the screen 38 in a second direction perpendicular to the first direction for receiving a shadow mask 52; the second direction is indicated in FIG. 2 as being along the x-axis. The mask 52 is in -turn affixed to the rails 48 and 50 preferably by welding the borders 54 and 56 of the mask 52 to the respective underlying rails 48 and 50 by means of a laser.

An inset 58 depicts a representative section of the shadow mask 52 greatly enlarged. Shadow mask 52 is shown as being a "strip mask" that consists of a plurality of strips 60 aligned in the first direction, and spaced apart as indicated by the intervening slits 62.

The strip mask 52 is formed from a metallic foil which may have a thickness in the range of 0.0003 inch to 0.005 inch, with the thickness dependent upon the size and application of the CRT. Such thin foils are basically non-self-supporting so they must be installed in a highly tensed state on the rails. Also, the magnitude of the tension must be high enough so that the tension is not lost when the mask expands thermally during operation. By way off example, and depending upon the thickness of the foil, the tension of a foil mask For a 14-inch (diagonal measure) CRT is about forty lb./in.

A form of the strip mask, the subject of U.S. Pat. No. 3,638,063 to Tachikawa et al, is shown by FIG. 3. The mask 66 consists of a parallel array of narrow strips 67, the ends of which are attached to curved supports 68 and 69. Tension is applied to the strips 67 of mask 66 by an outward pressure on supports 68 and 69 exerted by two U-shaped spring members 70 and 71. As a result, the mask is formed into into a sector of a cylindrical surface that conforms to the curvature of the associated faceplate (not shown). The disadvantages in a mask assembly of this type include its its bulk and weight, and the tendency of the strips 67 to vibrate and distort the image that is visible through the external surface of the associated curved faceplate.

The vibration problem is remedied in Tachikawa et al by the stretching of one or more fine wires, represented by the single wire 72, over the cylindrical surface of the mask, which serves to dampen vibration by contact with the strips 67. The wire 72 is shown as being are suspended between two spring members 74 and 75 attached to respective U-shaped spring members 70 and 71.

The problem of strip vibration is inherent in all types of strip mask, including the strip masks typified by those described and claimed in commonly owned U.S. Pat. Nos. 4,942,332 and 5,085,606. Damping vibration in strip masks of the type described in the patents presents problems due to the basic differences between the CRT described heretofore and Tachikawa et al. For example, the mask of the present invention is flat rather than curved, and the mounting means comprise rails that project from a flat faceplate. Further, there are no available structures nearby (as in Tachikawa et al) for the suspension of the wire. As a result, an inventive solution is required to achieve damping of strip vibration in flat strip masks mounted on rails secured to a flat faceplate.

This invention is applicable as well to a tension mask CRT having a slightly curved shadow mask, as disclosed in commonly owned referent copending application Ser. No. 07/974,443.

OBJECT OF THE INVENTION

Accordingly, it is the object of the invention to provide improved means for mounting a wire in vibration-damping conjunction with a strip mask used in a CRT having a flat faceplate.

BRIEF DESCRIPTION OF THE DRAWINGS

The features of the present invention believed to be novel are set forth with particularity in the appended claims. The invention, together with further objects and advantages thereof, may be best understood by reference to the following description taken in conjunction with the accompanying drawings (not to scale) in the several figures of which like reference numerals identify like elements, and in which:

DESCRIPTION OF THE PREFERRED EMBODIMENT

Figure 1:
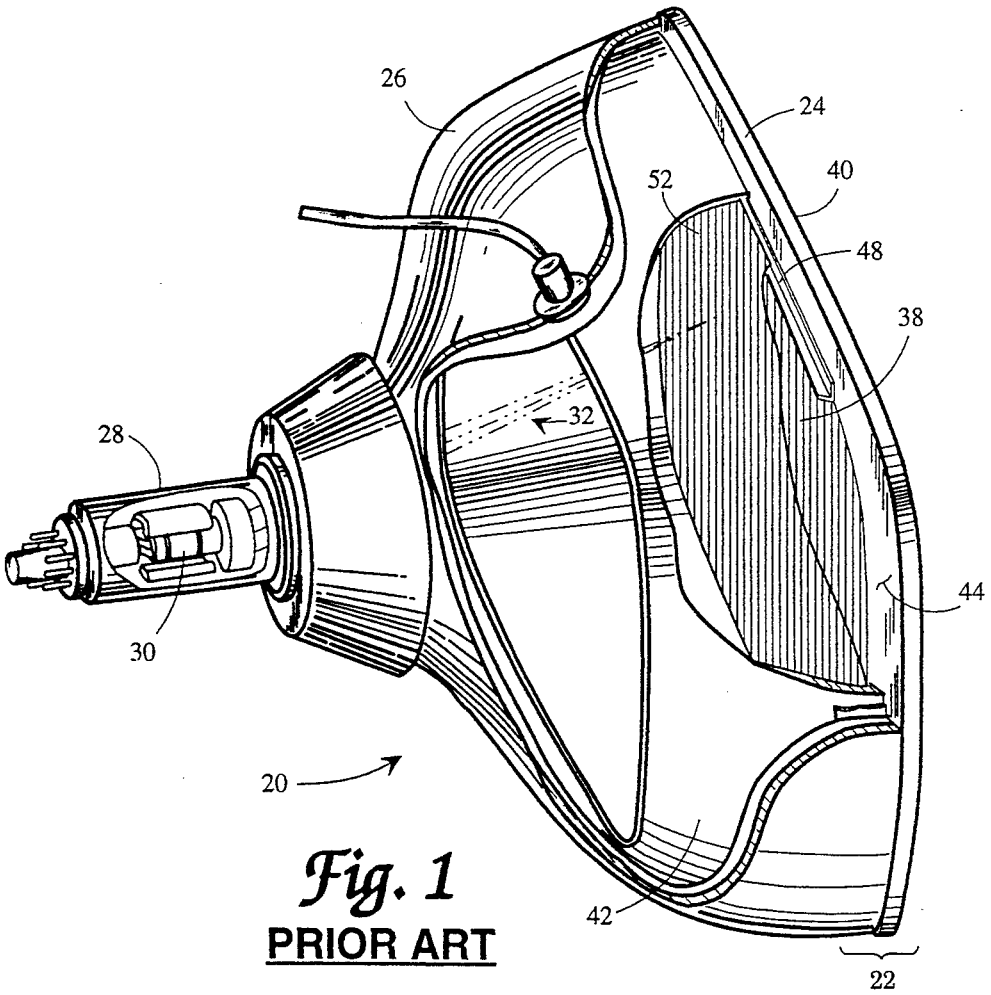
Fig. 1 PRIOR ART
FIG. 1 is a side view in perspective of a striped-screen tension mask color CRT known in the art and related to the present invention, with cutaway sections that reveal the location and relationship of the major components of the tube.
Figure 2:
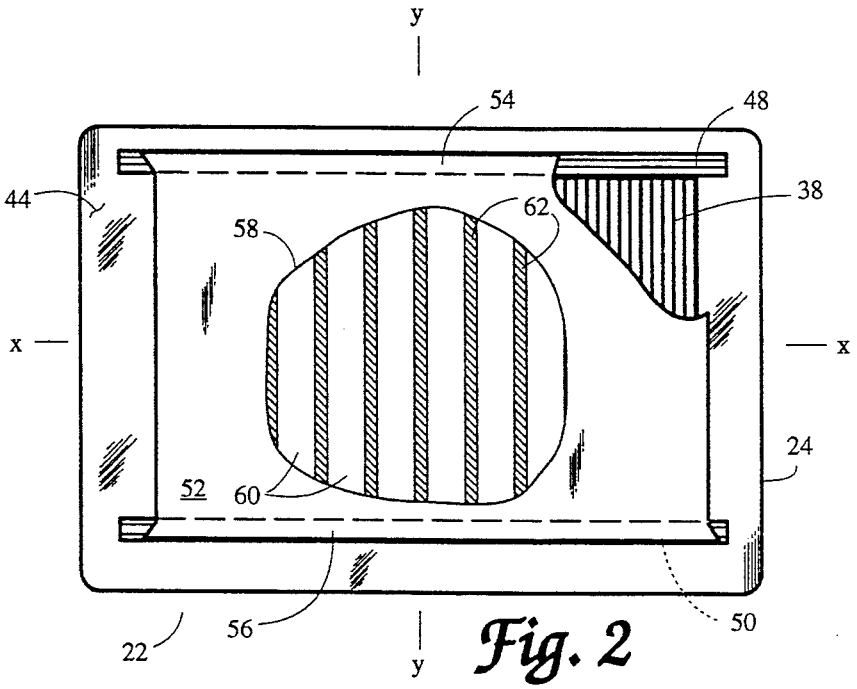
Fig. 2 PRIOR ART
FIG. 2 is a plan view of the front assembly of the CRT of FIG. 1 as seen from the viewpoint of the electron gun, and with parts cut away to show the relationship of a strip shadow mask with the faceplate and the striped screen; an inset depicts the strips of the mask greatly enlarged.
Figure 3:
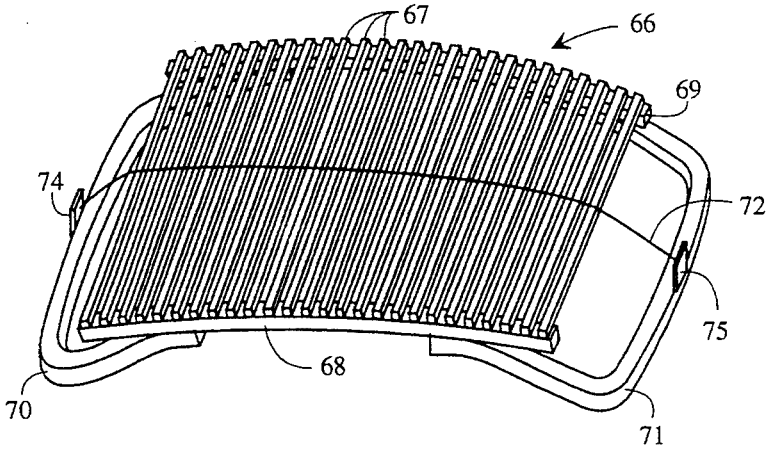
Fig. 3 PRIOR ART
FIG. 3 is a perspective view of a form of a curved strip mask in the prior art.
Figure 4:
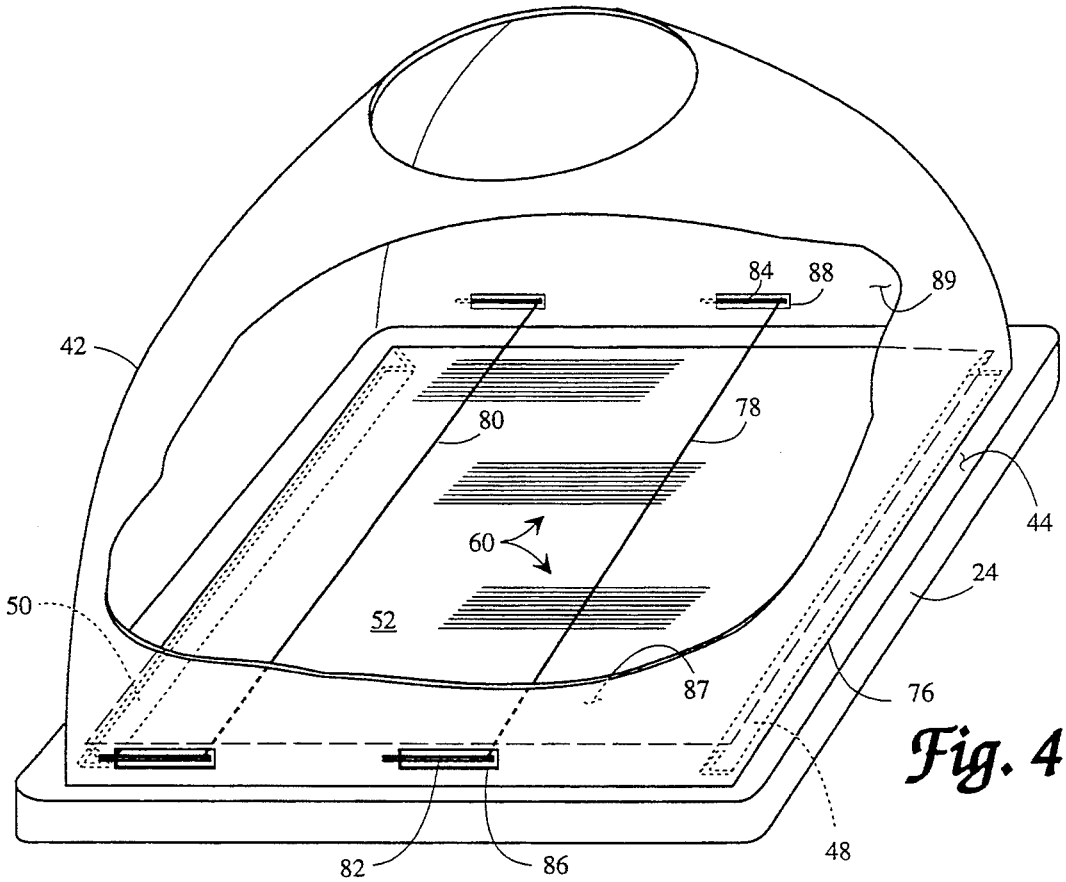
FIG. 4 is a perspective view of a partially cut away internal magnetic shield in conjunction with a faceplate.
Figure 5:
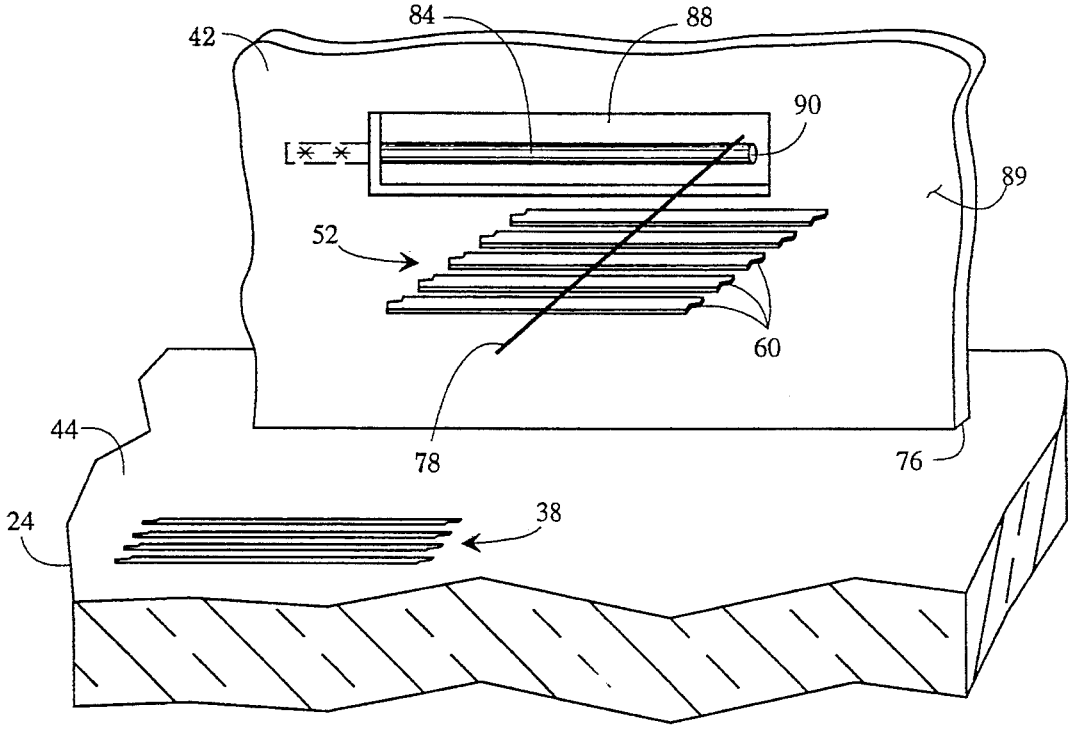
FIG. 5 depicts details of a means for supporting a vibration-damping wire in the structure of the magnetic shield shown by FIG. 4, and the relationship of the wire to the strips a strip-type shadow mask, shown as segments.

FIGS. 4 and 5 are depictions of means according to the invention For suspending a vibration-damping wire as installed in the CRT 20 depicted in FIGS. 1 and 2. During manufacture of CRT 20, the hollow magnetic shield 42, mounted internally with respect to the funnel 26, is placed on the faceplate 24 so that its rim 76 is flush with the inner surface 44 of faceplate 24, as indicated. The magnetic shield 42 fits closely over the two mask-supporting rails 48 and 50, indicated by the phantom lines, which support the shadow mask 52. The magnetic shield 42 may be held inplace by tack-welding it to the respective rails 48 and 50.

The magnetic shield 42 supports at least one vibration-damping wire according to the invention, indicated by way of example in FIG. 4 as comprising two wires 78 and 80 that lie across the the strips 60 of the strip mask 52. Using the vibration-damping wire 78 as an example, wire 78 is suspended from, and tensed by, at least one spring means; in this example, two reed springs 82 and 84 are depicted installed in respective cut-out sections 86 and 88 in the First wall 87 and second wall 89 of the magnetic shield 42. The detail view of FIG. 5 shows the reed spring 84 centered in the cutout section 88 wall 89 of the magnetic shield 42.

The reed springs 82 and 84 may comprise Hastelloy B (TM) nickel alloy 0.020 thick. The attachment of reed spring 84 (and 82) to the material of the magnetic shield 42 is accomplished by means of welding, as indicated by the weld symbols (*).

The vibration-damping wire 78 overlies the end 90 of reed spring 82, and it may be tack welded to the end 90 of reed spring 82. By its suspension from reed springs 82 and 84, and by the placement of the magnetic shield in relation to the mask 60, vibration-damping wire 78 is held in physical contact with the strips 60 of the strip mask 52 to damp image-distorting vibration. In the absence of vibration of the strips 60, the picture image formed by the phosphor stripes of screen 38 will be undistorted.

The magnetic shield 42 is preferably emplaced on the faceplate 24 with the vibration-damping wire 78 and 80 already installed and at the proper tension for effective damping of the vibration of the strips 60 of the mask 52. The locations of the vibration damping wires 78 and 80 are established with respect to the inner surface 44 of the faceplate 24 prior to the installation of the magnetic shield 42. The magnetic shield 42 is so designed, and the cutouts 86 and 88 and respective reed springs 82 and 84 are so located, that when the rim 76 of the magnetic shield 42 contacts the inner surface 44 of faceplate 24 during installation of the magnetic shield 42, the vibration damping wires 78 and 80 will come to rest on the strips 60 of the mask 52.

Figure 6:
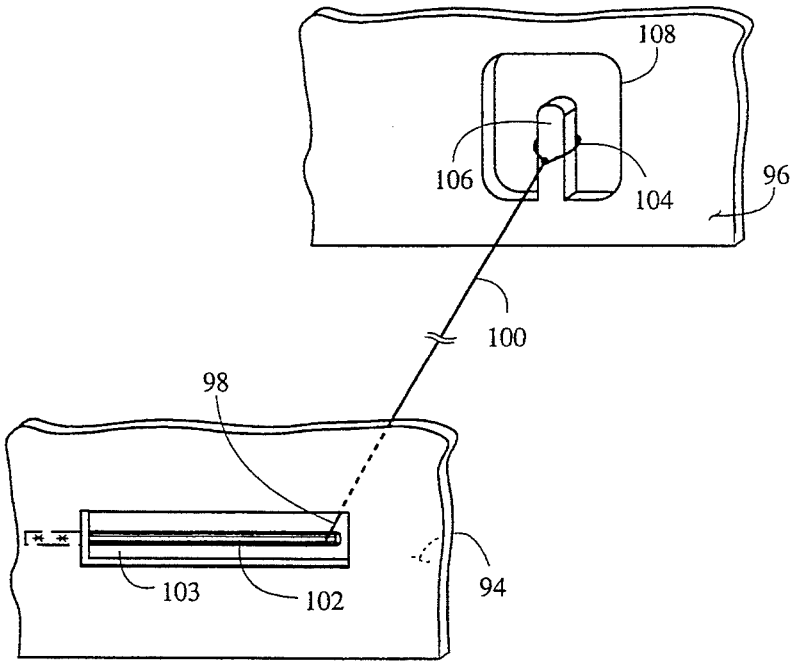
FIG. 6 depicts representative sections of the walls of an internal magnetic shield, and indicates an alternate means For supporting a vibration-damping wire.

As depicted in FIG. 6, a single spring may be used for suspending and applying tension to a vibration-damping wire. A first wall 94 and a second wall 96, indicated schematically as representative sections of a magnetic shield, are depicted. An end 98 of a vibration-damping wire 100 is attached to a single reed spring 102 mounted in a cut-out section 103 in the wall 94 in a manner depicted heretofore in connection with FIGS. 4 and 5. A loop 104 in the opposite end of the vibration-damping wire 100 is attached directly to wall 96 by virtue of its captivation by a post 106 formed in the cut-out section 108 of the wall 96. The tension on a vibration-damping wire must be relatively small to avoid deforming the thin foil of the strips 60 of which the mask 52 is composed. Also, a vibration-damping wire must be strong enough to enable it to withstand the tension applied, yet be so small in diameter as to be relatively invisible on the imaging screen. Based on a wire having a diameter of 0.0005 inch, a tension of four grams is suggested, by way of example. A vibration-damping wire may be made of tungsten or stainless steel.

While a particular embodiment of the invention has been shown and described, it will be readily apparent to those skilled in the art that changes and modifications may be made in the inventive means and method without departing from the invention in its broader aspects. This statement applies particularly to the reed springs depicted herein for applying tension to a vibration-damping wire. Other forms of tensioning means are equally practicable and within the purview of the invention, and will suggest themselves to those skilled in the art. Therefore, the aim of the appended claims is to cover all such changes and modifications as fall within the true spirit and scope of the invention.

What is claimed is:

1. A color CRT having a faceplate sealed to a funnel, and including:

a) a tensed shadow mask comprising strips of foil;

b) a magnetic shield internal to the funnel and having walls approximately conforming to the shape of funnel;

c) at least one wire suspended between the walls of the magnetic shield and in contact with the strips;

1) the wire being suspended in tension by spring means, the spring means attached to at least one wall of the magnetic shield for suspending the wire;

whereby image-distorting vibration of the strips of the shadow mask is damped by the wire.

2. The color CRT of claim 1 wherein an end of the wire is suspended between spring means attached to one wall, and the opposite end is attached directly to the opposite wall.

3. The color CRT of claim 1 wherein cut-out sections in the walls of the magnetic shield provide for receiving the spring means.

4. The color CRT of claim 1 wherein the spring means comprises at least one reed spring.

* * * * *